US006135518A

United States Patent [19]

Holthaus

[11] Patent Number: 6,135,518

[45] Date of Patent: Oct. 24, 2000

[54] BAG SUPPORT

[76] Inventor: John J. Holthaus, 14562 Burnley Ct., Chesterfield, Mo. 63017

[21] Appl. No.: 09/311,475

[22] Filed: May 13, 1999

[51] Int. Cl.[7] ..... B65B 67/04

[52] U.S. Cl. ..... 294/1.1; 248/97; 248/99; 141/337

[58] Field of Search ..... 294/1.1, 55; 248/95, 248/97, 99; 15/257.1, 257.3, 257.9; 141/313, 314, 316, 337, 390, 391

[56] References Cited

U.S. PATENT DOCUMENTS

| | | | |
|---|---|---|---|
| 474,382 | 5/1892 | Haines | 141/316 |
| 3,288,325 | 11/1966 | Fulton | 220/65 |
| 3,324,906 | 6/1967 | Chu | 141/337 |
| 3,936,087 | 2/1976 | Alexander | 294/1 R |
| 3,983,914 | 10/1976 | Benson | 141/390 |
| 4,268,081 | 5/1981 | Hawkinson | 294/55 |
| 4,530,533 | 7/1985 | Dieter | 294/1.1 |
| 4,832,292 | 5/1989 | Beckham | 248/99 |
| 4,892,224 | 1/1990 | Graham | 220/404 |
| 4,901,959 | 2/1990 | Stage | 248/97 |
| 5,031,948 | 7/1991 | Groth et al. | 294/1.1 |
| 5,107,666 | 4/1992 | Rachtican | 56/202 |
| 5,207,425 | 5/1993 | Cohrs | 141/337 |
| 5,271,589 | 12/1993 | Belous | 248/97 |
| 5,593,117 | 1/1997 | Alexander, III | 248/99 |
| 5,765,614 | 6/1998 | Kardosh | 141/390 |
| 5,868,364 | 2/1999 | MacMillan | 248/97 |
| 5,871,037 | 2/1999 | Feldt | 141/391 |
| 5,915,768 | 6/1999 | Young | 294/1.1 |

*Primary Examiner*—Dean J. Kramer
*Attorney, Agent, or Firm*—Grace J. Fishel

[57] ABSTRACT

A bag support for a paper or plastic trash bag such as are commonly used to gather lawn and garden waste for disposal. The bag support has a funnel connected to a nozzle with a nozzle outlet. The funnel and the nozzle are rectangular in cross-section with opposing side walls and end walls. Slots are provided in the opposing side walls or the end walls or both of the nozzle. The funnel and nozzle are integral and the bag support is preferably formed in two identical sections with complementary male and female couplings for releasably joining the sections.

7 Claims, 3 Drawing Sheets

BAG SUPPORT

BACKGROUND OF THE INVENTION

1. Field of the Invention

The present invention relates to a bag support for a paper or plastic trash bag such as are commonly used to gather lawn and garden waste for disposal.

2. Brief Description of the Prior Art

Each autumn, homeowners across the United States rake up fallen leaves from their lawns. In the past, the smell of burning leaves, as much as the opening of schools and football games, heralded the beginning of fall. Many communities, however, have banned leaf burning because of air pollution, health problems and fire hazards.

People now rely on waste pick-up services for disposal of leaves and other yard wastes. Large plastic bags have been developed for this purpose. Because of scarce landfill space and other environmental concerns, however, many state and local governments have outlawed plastic bags, even those made of a biodegradable plastic, and require that leaves and other yard trimmings be loose or in paper bags that are readily degraded.

Neither plastic bags or paper bags are easy for the homeowner to use. Sometimes, it is more convenient to lay the bag on the ground and sweep the debris into the bag, other times, it is more convenient for the bag to be upright and lift the leaves into the bag. Either way, it is difficult for a person to hold the mouth of the bag open while filling it with lawn and yard waste. In addition, if the user attempts to tamp the waste down in the bag to reduce the volume (and save on bags), the bag may rupture, whether it is made of plastic or paper.

There have been funnel and scoop shaped devices proposed for holding the mouth of a big trash bag open. In some of them, when the yard waste is packed down, the waste sticks to the sidewalls of the device and comes out of the bag with the funnel or scoop. Some devices support the bag open, as well as upright for top filling, others support the bag on its side for sweep filling, but few can be used to support the bag either way. Another (or an additional) problem with many of the prior art devices is that they do not collapse down for shipment or storage, which is a real shortcoming for a piece of equipment having limited or only seasonal use. Some devices are designed exclusively for use with plastic bags, others are for use with paper bags, while few are suitable for both.

BRIEF SUMMARY OF THE INVENTION

In view of the above, it is an object of the present invention to provide a bag support to hold the mouth of a paper or plastic trash bag open. It is another object to provide a bag support that will hold the bag upright for lifting lawn and yard waste into the bag or on its side for sweep filling. It is also an object to provide a bag support that will collapse down for shipment or storage. Other objects and features of the invention will be in part apparent and in part pointed out hereinafter.

In accordance with the invention, a bag support is provided for use with a paper or plastic trash bag such as are commonly used to gather lawn or yard debris. The bag support has a tapered funnel and an elongated nozzle. The funnel has a top funnel inlet and a bottom funnel outlet and the elongated nozzle has a top nozzle inlet and a bottom nozzle outlet. The nozzle is adapted to just slip inside the trash bag, said trash bag having a bag mouth, a side wall and a bag bottom situated generally opposite the bag mouth. The top nozzle inlet is flowably connected to the bottom funnel outlet and the nozzle outlet is adapted to be seated on the bag bottom.

The funnel and the nozzle are generally rectangular in cross-section and each has four sidewalls, arranged in two opposing pairs. The nozzle has a longitudinal slot in each of at least one of the opposing pairs of sidewalls, with slots opening from the bottom nozzle outlet and extending substantially the length of the nozzle to a collar formed as an integral part of the opposing pairs of sidewalls at the nozzle inlet.

In a preferred embodiment, the funnel and the nozzle are integral and the bag support is formed in two identical sections with complementary male and female coupling means for releasably joining the sections.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
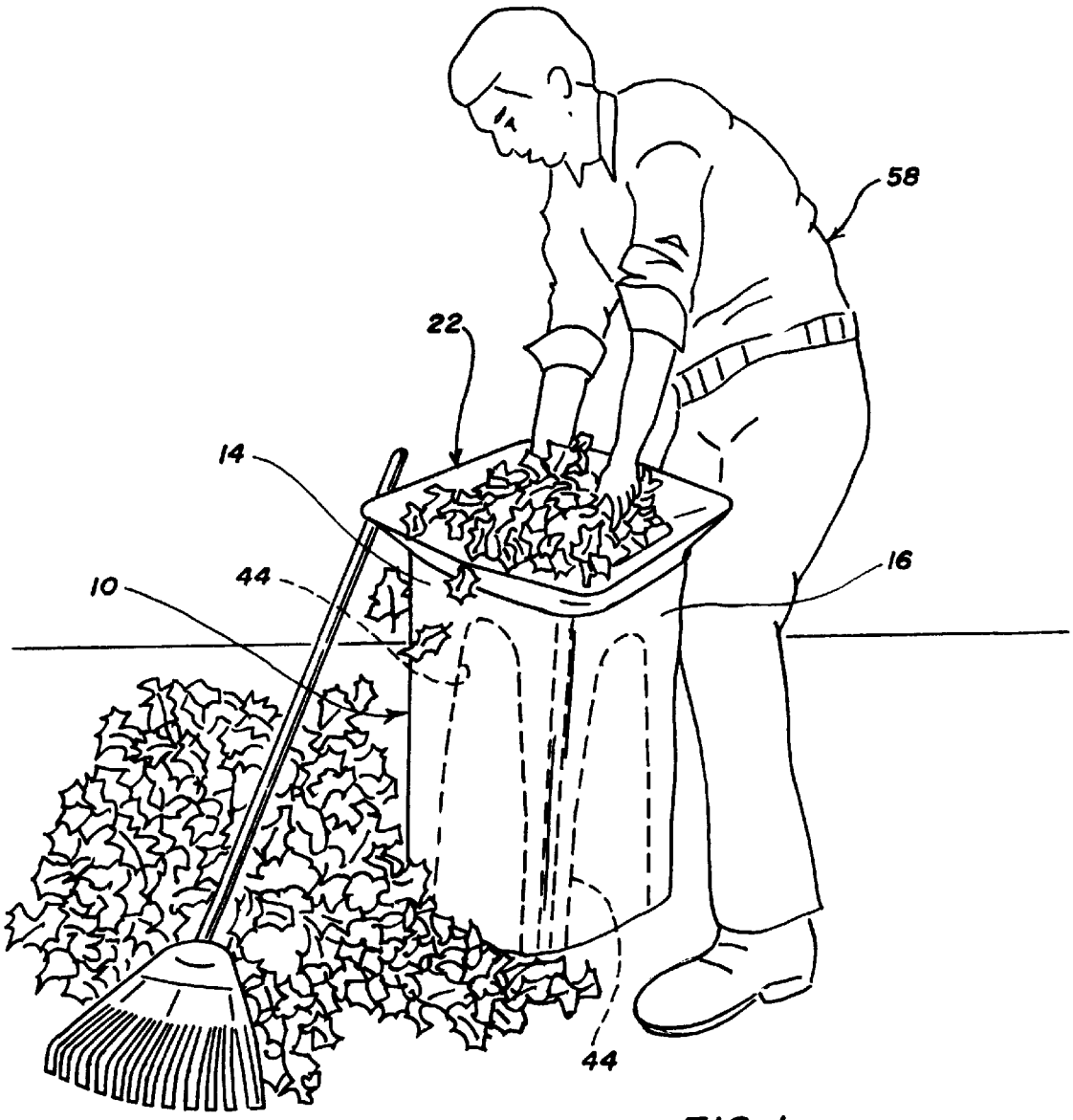
FIG. 1 illustrates a bag support in accordance with the present invention in use holding a trash bag upright for filling.

Conventional trash bags 10 for lawn and garden waste are made of paper or a thin plastic material such as three mil thick vinyl plastic. Paper and plastic trash bags are of comparable size since they are used interchangeably, where plastic is not prohibited by local governments, and are considered disposable. Paper bags 10 have a bag mouth 12, side walls 14, end walls 16, and a rectangular bottom 18. Such bags are usually made of brown paper and fold flat for storage by reason of a center crease 20 in end walls 16 and other creases of well known type. Plastic bags 10 have a bag mouth 12 but side walls 14 and end walls 16 are formed as one elongated continuous sidewall that extends between bag bottom 18 and bag mouth 12. Bag bottom 18 is usually formed by folding plastic bag 10 flat and heat sealing both halves of the elongate sidewall together.

A bag support 22 in accordance with the present invention is capable of supporting paper or plastic trash bag 10 with bag mouth 12 open and bag 10 upright for top filling or with bag 10 on its side for sweep filling as more particularly described hereinafter. Bag support 22 has a tapered funnel 24 joined to an elongated nozzle 26. Tapered funnel 24 has a top funnel inlet 28 and a bottom funnel outlet 30 and is generally rectangular in cross-section with a pair of opposing sloped rectangular side walls 32 and a pair of opposing sloped rectangular end walls 34.

Figure 2:
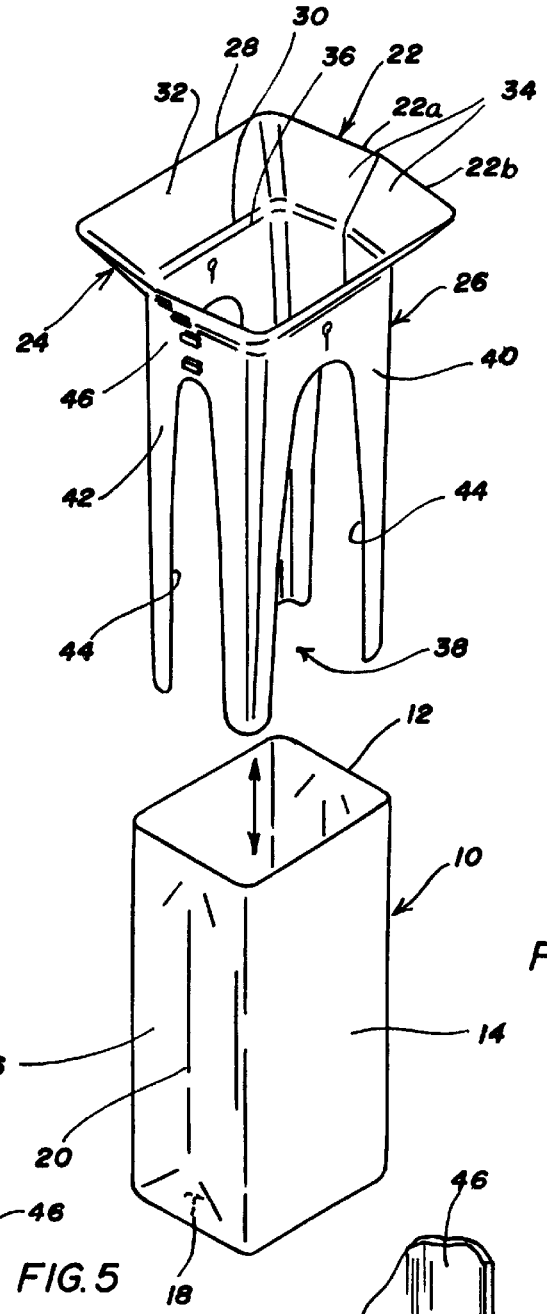
FIG. 2 is a perspective view of the bag support being inserted or removed from a paper trash bag.

Elongated nozzle 26 has a top nozzle inlet 36 and a bottom nozzle outlet 38 and is also generally rectangular in cross-section with a pair of opposing side walls 40 and a pair of opposing end walls 42. Top nozzle inlet 36 is flowably connected to bottom funnel outlet 30. Elongated nozzle 26 may taper slightly towards nozzle outlet 38 for ease in insertion into bag 10. As shown in FIG. 2, nozzle 26 is adapted to just slip inside trash bag 10 such that side walls 14 and end walls 16 of bag 10 are close to the outside of the nozzle when nozzle outlet 38 is seated on bag bottom 18.

A longitudinal slot 44 is provided in opposing side walls 40 or opposing end walls 42 of nozzle 26. Preferably, as shown in the drawings, slots 44 are formed in both side walls 40 and end walls 42 for use as described below. Slots 44 open from bottom funnel outlet 30 and extend substantially the length of nozzle 26 to a collar 46 formed as an integral part of opposing side walls 40 and opposing end walls 42.

Figure 6:
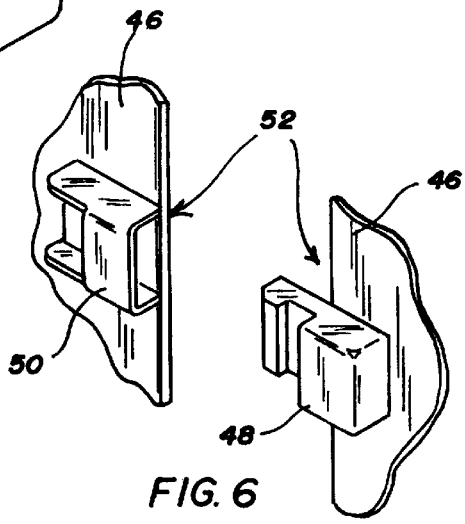
Figure 3:
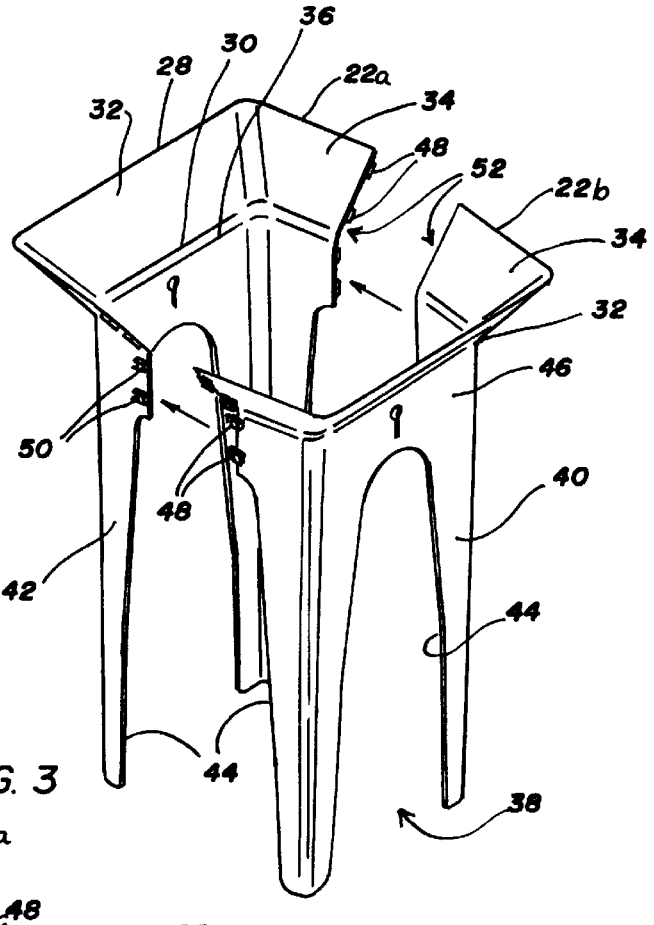
FIG. 3 is a perspective view of the bag support formed of two identical sections which may be coupled together for use and uncoupled for storage or shipment.

As best seen in FIG. 3, funnel 24 and elongated nozzle 26 are integral and bag support 22 is formed in two identical sections 22*a*, 22*b*. Complementary male and female coupling means 48, 50, a representative one of which is shown in FIG. 6, are provided for releasably joining said sections 22*a*, 22*b*. In a preferred form, a parting line 52 for sections 22*a*, 22*b* is provided at the midpoint of end walls 34, 42 and spaced sets of male and female coupling means 48, 50 are provided along parting line 52 on funnel 24 and collar 46.

Figure 5:
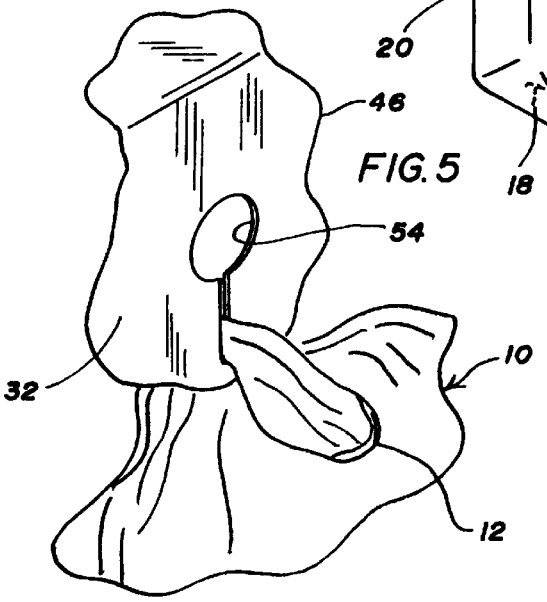
FIG. 5 is perspective view, on enlarged scale from the inside of a collar, of a portion of a plastic bag secured in a keyhole provided in the collar portion of the side wall of the nozzle; and, FIG. 6 is a perspective view of a representative coupling means for joining the identical sections of the bag support.

A keyhole slot 54 or the like is formed in collar 46 on side walls 40 for use as shown in FIG. 5. When sections 22*a*, 22*b* are stacked as shown in FIG. 4, keyhole slots 54 can also be used to hang bag support 22 up for storage.

Figure 4:
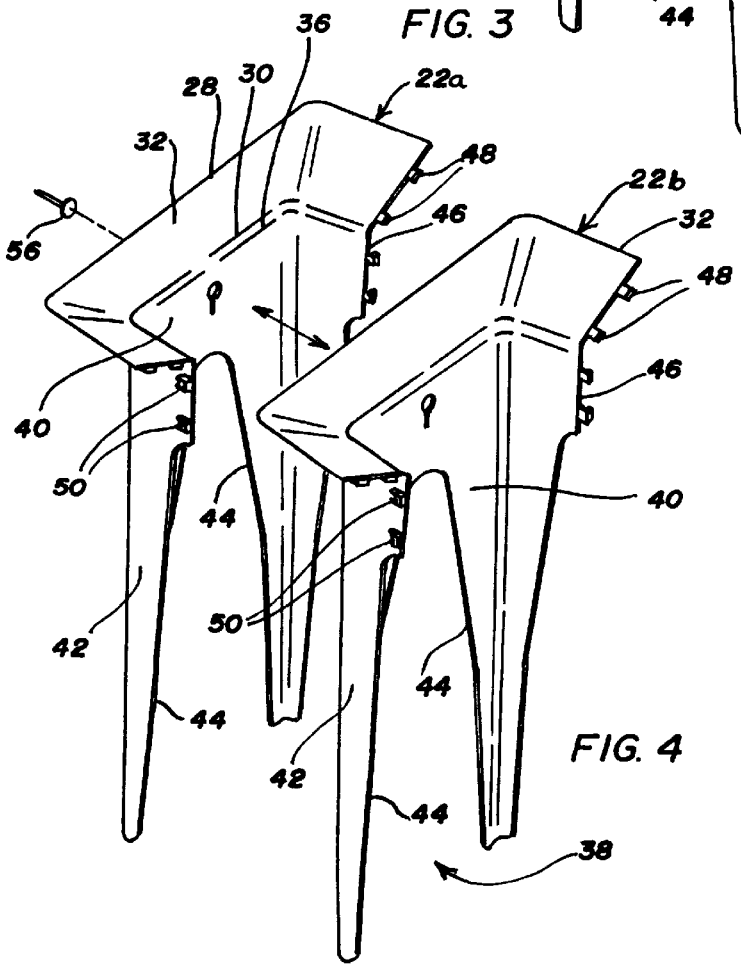
FIG. 4 is a perspective view of the bag support with one of the identical sections separated and reversed, one section nested within the other, for storage or shipment.

In use, bag support 22 can be disassembled as shown in FIG. 4 and sections 22*a*, 22*b* nested for transport or storage. For storage, as mentioned above, sections 22*a*, 22*b* may be hung by keyhole slots 54 on a hook or nail 56. When needed, sections 22*a*, 22*b* are readily separated and reversed, as shown in FIG. 3, and male and female coupling means 48, 50 snapped together to assemble the bag support. The outside of side walls 40 and end walls 42 just fits within bag mouth 12 as bag support 22 is slipped into a paper bag as shown in FIG. 2 or as a plastic bag is drawn over nozzle 26. In the case of a paper bag, the bag may be stiff enough to stand upright and there may be sufficient interference fit between the bag and nozzle 26 such that the bag does not need to be secured to the bag support at collar 46. When bag 10 is plastic, a portion of the bag on opposite sides of bag mouth 12 may be passed through the eye of keyhole 54 and caught in its stem as shown in FIG. 5 to attach the bag to the bag support.

Bag support 22 holds bag mouth 12 open and bag 10 upright for top filling. If a user 58 prefers to sweep the debris into the bag, bag support 22 may be laid on the ground and rectangular side walls 32 of funnel 24 work like a dustpan, providing a ramp for sweeping the debris into bag 10.

It is possible for user 58 to bag yard and lawn waste much faster with bag support 22 because bag mouth 12 stays open. In addition, it possible to pack more yard waste into each bag without splitting the bag as side walls 40 and end walls 42 of nozzle 26 tend to confine the debris within the nozzle while it is being packed down.

After the bag is filled, user 58 grips funnel 24 and pulls bag support 22 from bag 10. Friction between the debris in bag support 22 through slots 44 and side walls 14 and end walls 16 of bag 10 keep the debris from being pulled out of the bag with the nozzle. In the absence of slots 44, the debris tends to stick in the nozzle and be pulled out with the bag support. After bag support 22 has been removed from bag 10, the bag may be folded over, tied or taped shut, ready for disposal. When bag support 22 is no longer needed, sections 22*a*, 22*b* may be uncoupled and stored on a nail or hook as described above.

Bag support 22 is preferably formed of a durable plastic material and should not be skeletonized, for example, by enlarging slots 44 such that the remaining portions of side walls 40 and end walls 42 are thin legs. A skeletonized bag support will not perform an equivalent function because sufficient amounts of side walls 40 and end walls 42 must be present to prevent the debris from rupturing the bag when the waste is compacted in the nozzle and to serve as a guide during removal of the bag support from the bag.

As seen from the above, bag support 22 is a simple structure that may be conveniently stored when not in use, that is easily assembled for use, and is inexpensive enough to justify its purchase for limited use in collecting yard and lawn waste. In addition, bag support 22 with bag 10 can be used for other purposes, inside or out, as a trash can for collecting other disposable or recyclable items such as aluminum cans, etc.

In view of the above, it will also be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A bag support comprising:

(a) a tapered funnel having a top funnel inlet and a bottom funnel outlet, (b) an elongated nozzle having a top nozzle inlet and a bottom nozzle outlet, said nozzle adapted to just slip inside a paper or plastic trash bag such as are commonly used to gather lawn and yard debris, said trash bag having a bag mouth, a side wall and a bag bottom situated generally opposite the bag mouth, said top nozzle inlet flowably connected to the bottom funnel outlet and said nozzle outlet adapted to be seated on the bag bottom, (c) said funnel and said nozzle being integral and generally rectangular in cross-section and each having four sidewalls, said sidewalls of the funnel and the nozzle arranged in two opposing pairs, (d) said nozzle having a longitudinal slot in each of at least one of the opposing pairs of sidewalls, said slots opening from the bottom nozzle outlet and extending substantially the length of the nozzle to a collar formed as an integral part of the opposing pairs of sidewalls at the nozzle inlet, and (e) said funnel and said nozzle being formed in two identical sections with complementary male and female coupling means releasably joining said sections.

2. A bag support comprising:

(a) a tapered funnel having a top funnel inlet and a bottom funnel outlet, (b) an elongated nozzle having a top nozzle inlet and a bottom nozzle outlet, said nozzle adapted to just slip inside a paper or plastic trash bag such as are commonly used to gather lawn and yard debris, said trash bag having a bag mouth, a pair of opposing side walls, a pair of opposing end walls and a rectangular bag bottom situated generally opposite the bag mouth, said top nozzle inlet flowably connected to the bottom funnel outlet and said nozzle outlet adapted to be seated on the bag bottom, (c) said funnel and said nozzle being generally rectangular in cross-section, said funnel having a pair of opposing sloped rectangular side walls and a pair of opposing sloped rectangular end walls, and said nozzle having a pair of opposing rectangular side walls and a pair of opposing rectangular end walls, (d) said nozzle having a longitudinal slot in at least one of said opposing pairs of side walls and end walls, said slots opening from the bottom nozzle outlet and extending substantially the length of the nozzle to a collar formed as an integral part of the opposing pairs of side walls and end walls and at the nozzle inlet.

3. The bag support of claim 2 wherein the funnel and the nozzle are integral and formed in two identical sections with complementary male and female coupling means releasably joining said sections.

4. The bag support of claim 3 wherein a parting line is provided between said sections in said end walls of the funnel and said end walls of the nozzle with a plurality of spaced sets of male and female coupling means along the parting line on the funnel and the collar.

5. The bag support of claim 4 further comprising a pair of opposing keyhole slots in the collar.

6. The bag support of claim 5 formed of a plastic.

7. The bag support of claim 5 wherein the side walls and end walls of the nozzle taper slightly towards the nozzle outlet to facilitate insertion of the bag support into the bag.

* * * * *